US007817950B2

(12) United States Patent
Burton et al.

(10) Patent No.: US 7,817,950 B2
(45) Date of Patent: Oct. 19, 2010

(54) APPARATUSES USEFUL FOR PRINTING AND METHODS OF STRIPPING MEDIA FROM SURFACES IN APPARATUSES USEFUL FOR PRINTING

(75) Inventors: William A. Burton, Fairport, NY (US); Anthony S. Condello, Webster, NY (US); Augusto E. Barton, Webster, NY (US); Stephen Bradley Williams, Marion, NY (US); Paul Michael Fromm, Rochester, NY (US); Lawrence Arnold Clark, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 63 days.

(21) Appl. No.: 12/363,724

(22) Filed: Jan. 31, 2009

(65) Prior Publication Data

US 2010/0196064 A1 Aug. 5, 2010

(51) Int. Cl.
*G03G 15/20* (2006.01)

(52) U.S. Cl. ..... 399/323; 399/45; 399/329

(58) Field of Classification Search ..... 399/323, 399/329, 45, 398, 399; 271/307, 308, 311, 271/312

See application file for complete search history.

(56) References Cited

U.S. PATENT DOCUMENTS 4,332,457 A * 6/1982 Mitsuyama et al. ..... 399/323
5,406,363 A * 4/1995 Siegel et al. ..... 399/323
7,593,678 B2 * 9/2009 Suenaga ..... 399/323
2006/0210331 A1 9/2006 Baba et al.
2007/0048035 A1 3/2007 Baba et al.
2007/0048042 A1 3/2007 Uehara et al.
2007/0092277 A1 4/2007 Miyata et al.
2007/0166084 A1 7/2007 Yoshino et al.
2007/0172272 A1 7/2007 Miyata et al.
2008/0037069 A1 2/2008 Mestha et al.
2009/0035035 A1 * 2/2009 Funabiki ..... 399/329

OTHER PUBLICATIONS

Anthony S. Condello et al.; U.S. Appl. No. 12/261,680, filed Oct. 30, 2008.

* cited by examiner

*Primary Examiner*—Sophia S Chen
(74) *Attorney, Agent, or Firm*—Prass LLP

(57) ABSTRACT

Apparatuses useful for printing and methods for stripping media from surfaces in apparatuses useful for printing are disclosed. An apparatus useful for printing including a first member including a first outer surface; a second member including a second outer surface; a belt including an inner surface and an outer surface; a first nip formed by contact between the inner surface of the belt and the second outer surface and contact between the outer surface of the belt and the first outer surface; and a stripping mechanism including a stripping member disposed internal to the belt. The stripping member is positionable relative to the first nip to vary a pressure applied by the outer surface of the belt against the first outer surface downstream from the first nip. The media are stripped from the outer surface of the belt after exiting from the first nip.

19 Claims, 6 Drawing Sheets

APPARATUSES USEFUL FOR PRINTING AND METHODS OF STRIPPING MEDIA FROM SURFACES IN APPARATUSES USEFUL FOR PRINTING

BACKGROUND

Some printing apparatuses include a belt and an opposed surface that form a nip. In such printing apparatuses, media are fed to the nip and contacted with the belt. The media are stripped from the belt after passing through the nip.

It would be desirable to provide apparatuses useful for printing and methods for stripping media from belts in apparatuses useful for printing that can be used to strip different types of media from belts more effectively.

SUMMARY

Apparatuses useful for printing and methods for stripping media from surfaces in apparatuses useful for printing are disclosed. An exemplary embodiment of the apparatuses useful for printing comprises a first member including a first outer surface; a second member including a second outer surface; a belt including an inner surface and an outer surface; a first nip formed by contact between the inner surface of the belt and the second outer surface and contact between the outer surface of the belt and the first outer surface; and a stripping mechanism comprising a stripping member disposed internal to the belt. The stripping member is positionable relative to the first nip to vary a pressure applied by the outer surface of the belt against the first outer surface downstream from the first nip. The media are stripped from the outer surface of the belt after exiting from the first nip.

DRAWINGS

DETAILED DESCRIPTION

Figure 1:
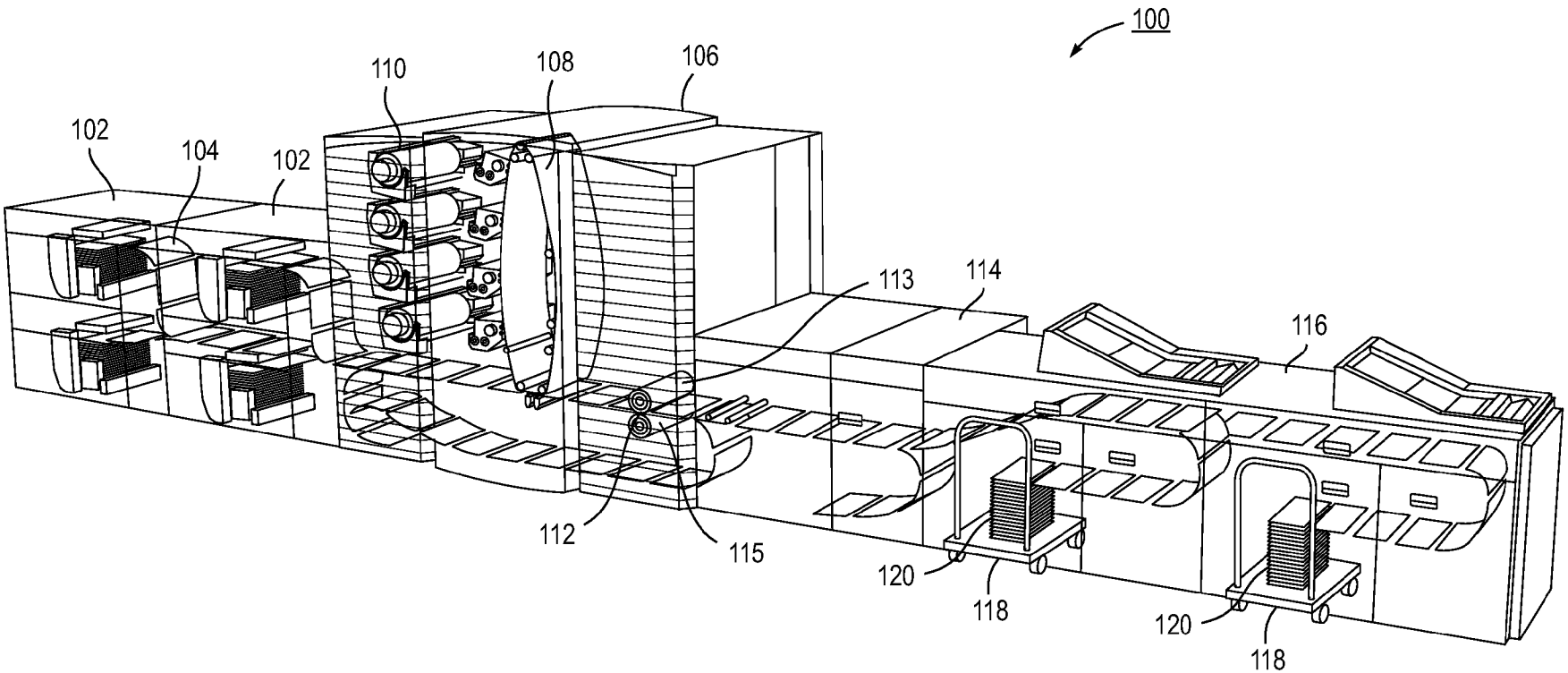
FIG. 1 depicts an exemplary embodiment of a printing apparatus.

The disclosed embodiments include an apparatus useful for printing comprising a first member including a first outer surface; a second member including a second outer surface; a belt including an inner surface and an outer surface; a first nip formed by contact between the inner surface of the belt and the second outer surface and contact between the outer surface of the belt and the first outer surface; and a stripping mechanism comprising a stripping member disposed internal to the belt. The stripping member is positionable relative to the first nip to vary a pressure applied by the outer surface of the belt against the first outer surface downstream from the first nip. The media are stripped from the outer surface of the belt after exiting from the first nip.

The disclosed embodiments further include an apparatus useful for printing comprising a first pressure roll including a first outer surface; a second pressure roll including a second outer surface; a heated belt including an inner surface and an outer surface; a first nip formed by contact between the inner surface of the belt and the second outer surface and contact between the outer surface of the belt and the first outer surface, the first nip including an inlet where media enter the first nip and an outlet where the media exit the first nip; and a stripping mechanism comprising: a motor; and a stripping member connected to the motor and disposed internal to the belt. The motor is operable to position the stripping member relative to the first nip to vary a pressure applied by the outer surface of the belt against the first outer surface downstream from the outlet of the first nip. The media are stripped from the outer surface of the belt after exiting from the outlet of the first nip. The disclosed embodiments further include a method of stripping media from a surface in an apparatus useful for printing. The apparatus comprises a first member including a first surface, a second member including a second surface, a belt including an inner surface and an outer surface, a first nip formed by contact between the inner surface of the belt and the second outer surface and contact between the outer surface of the belt and the first outer surface, and a stripping mechanism including a stripping member disposed internal to the belt. The method comprises positioning the stripping member relative to the first nip to vary a pressure applied by the outer surface of the belt against the first outer surface downstream from an outlet of the first nip to a first pressure; contacting a first medium carrying a first marking material with the outer surface of the belt at the first nip; and stripping the first medium from the outer surface of the belt downstream from the first nip with the stripping member.

As used herein, the term "printing apparatus" encompasses any apparatus, such as a digital copier, bookmaking machine, multi-function machine, and the like, that can perform a print outputting function for any purpose.

FIG. 1 illustrates an exemplary printing apparatus 100, as disclosed in U.S. Patent Application Publication No. 2008/0037069, which is incorporated herein by reference in its entirety. The printing apparatus 100 can be used to produce prints from various types of media at high speeds. The media can have various sizes and weights. The printing apparatus 100 includes two media feeder modules 102 arranged in series, a printer module 106 adjacent the media feeding modules 102, an inverter module 114 adjacent the printer module 106, and two stacker modules 116 arranged in series adjacent the inverter module 114.

In the printing apparatus 100, the media feeder modules 102 are adapted to feed coated or uncoated media having various sizes and weights to the printer module 106. In the printer module 106, marking material (toner) is transferred from a series of developer stations 110 to a charged photoreceptor belt 108 to form toner images on the photoreceptor belt and produce color prints. The toner images are transferred to one side of media 104 fed through the paper path. The media are advanced through a fuser 112 including a fuser roll 113 and pressure roll 115. The inverter module 114 manipulates media exiting the printer module 106 by either passing the media through to the stacker modules 116, or inverting and returning the media to the printer module 106. In the stacker modules 116, the printed media are loaded onto stacker carts 118 to form stacks 120.

In the illustrated printing apparatus 100, the fuser roll 113 and the pressure roll 115 forms a nip at which heat and pressure is applied to media carrying marking material to treat the marking material. The fuser roll 113 can include an outer layer made of an elastomeric material having an outer surface region that experiences strain when the fuser roll 113 and pressure roll 115 are engaged with each other. This strain is also referred to herein as "creep." In the fuser 112, creep of the outer layer of the fuser roll 113 is used to strip media from the fuser roll 113 after the media pass through the nip. In such fusers, high creep is typically used to strip less-rigid, light-weight media, while lower creep is used to strip more-rigid, heavy-weight media.

Another type of fuser includes a pressure roll and a thick belt for treating marking material on media. Thick belts typically have a thickness of about 1 mm to about 5 mm. In such fusers, creep that occurs in the belt is used for stripping media from the belt.

It has been noted that it is difficult to simultaneously optimize both marking material treating and media stripping functions for all media weights in apparatuses that include a pressure roll and thick belt. For example, when such fusers are operated using the same creep and nip width conditions for all media weights, instead of using the optimal conditions for each different media type, light-weight media can be over-fused, while heavy-weight media can generate excessive edge-wear in the thick belts.

Apparatuses useful for printing are provided. Embodiments of the apparatuses include a belt. In embodiments, the belt and another member, such as an external pressure roll or a second belt, form a nip. One or more rolls supporting the belt can be heated to control the temperature of the belt. At the nip, the belt and external roll apply heat and/or pressure to treat marking material on media. The media are then separated (stripped) from the belt. Embodiments of the apparatuses are constructed to separate the marking material treatment function (e.g., fusing) from the media stripping function to provide extended belt life.

Figure 2:
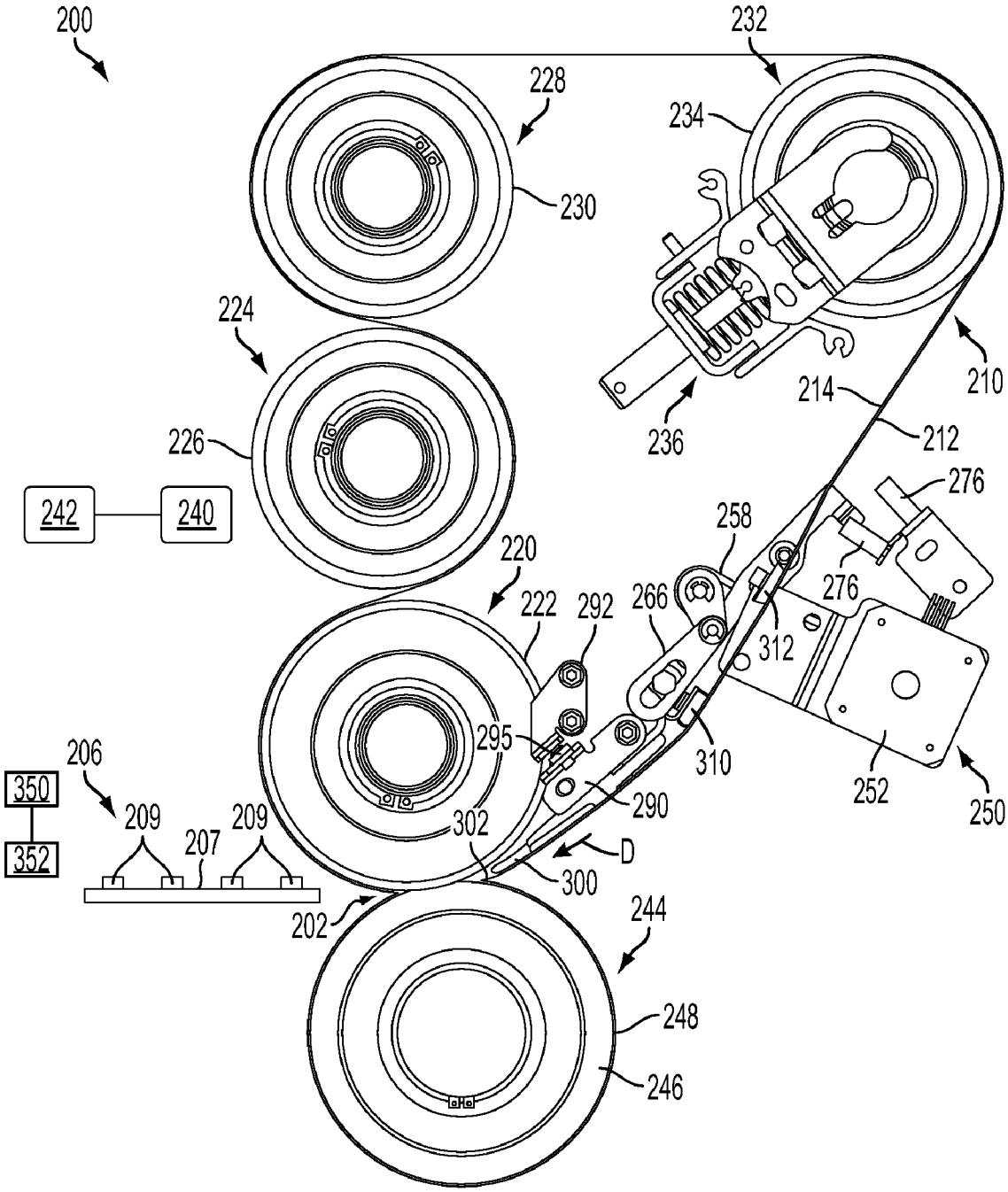
FIG. 2 depicts an exemplary embodiment of an apparatus useful for printing including a media stripping mechanism.

FIG. 2 illustrates an exemplary embodiment of an apparatus useful for printing. The apparatus is a fuser 200. The fuser 200 is constructed to decouple the marking material treatment function (e.g., fusing function) and the media stripping function for all media weights that may be used in the fuser. Embodiments of the fuser 200 can be used in different types of printing apparatuses. For example, the fuser 200 can be used in the printing apparatus 100 shown in FIG. 1, in place of the fuser 112.

As shown in FIG. 2, the fuser 200 includes an endless (continuous) belt 210 supported by an internal pressure roll 220, an external roll 224 and internal rolls 228 and 232. Other embodiments of the fuser 200 can have different architectures including a different number of rolls supporting the belt 210. The internal roll 232 includes a steering and tensioning mechanism 236 to allow re-positioning of the internal roll 232 and adjustment of the tension in the belt 210.

The belt 210 includes an outer surface 212 and an inner surface 214. The internal pressure roll 220 and the internal rolls 228, 232 include respective outer surfaces 222, 230 and 234 contacting the inner surface 214 of the belt 210. The external roll 224 includes an outer surface 226 contacting the outer surface 212 of the belt 210. In embodiments, at least the external roll 224 and the internal roll 228 are heated. The internal pressure roll 220 and/or the internal roll 232 can optionally also be heated. In embodiments, the external roll 224 and the internal roll 228, and optionally the internal pressure roll 220 and/or the internal roll 232, include an internal heat source (not shown), such as one or more axially-extending lamps. The heat sources can be electrically connected to a power supply 240. In embodiments, the power supply 240 is electrically connected to a controller 242. The controller 242 is adapted to control the power supply 240 to control the power output of the heat sources in order to control the temperature of the belt 210 during warm-up, standby and print runs. The belt 210 can be heated to a temperature effective to treat (e.g., fuse) marking material on different types of coated or un-coated media.

The fuser 200 further includes an external pressure roll 244 having an outer layer 246 with an outer surface 248. In embodiments, the outer layer 246 is comprised of an elastically deformable material, such as silicone rubber, perfluoroalkoxy (PFA) copolymer resin, or the like.

Embodiments of the belt 210 can have a multi-layer construction including, e.g., a base layer, an intermediate layer on the base layer, and an outer layer on the intermediate layer. In such embodiments, the base layer forms the inner surface 214 of the belt 210 contacting the outer surfaces 222, 230 and 234 of the internal pressure roll 220 and the internal rolls 228, 232, respectively. The outer layer of the belt 210 forms the outer surface 212 contacting the outer surface 226 of the external roll 224 and the outer surface 248 of the external pressure roll 244. In an exemplary embodiment of the belt 210, the base layer is composed of a polymeric material, such as polyimide, or the like; the intermediate layer is composed of silicone, or the like; and the outer layer is composed of a polymeric material, such as a fluoroelastomer sold under the trademark Viton® by DuPont Performance Elastomers, L.L.C., polytetrafluoroethylene (Teflon®), or the like.

In embodiments, the belt 210 may have a thickness of about 0.1 mm to about 0.6 mm, and be referred to as a "thin belt." For example, the base layer can have a thickness of about 50 μm to about 100 μm, the intermediate layer a thickness of about 100 μm to about 500 μm, and the outer layer a thickness of about 20 μm to about 40 μm. The belt 210 can typically have a width of about 350 mm to about 450 mm, and a length of about 500 mm to 1000 mm, or even longer.

In embodiments, the one or more outer elastomeric layers of the belt 210 are sufficiently thin, and the outer surface 222 of the internal pressure roll 220 is sufficiently soft, that the elastomeric layer(s) experience only minimal creep when the outer surface 222 and the outer surface 248 of the external pressure roll 244 engage the belt 210. These features can minimize relative motion between media and the outer surface 212 of the belt 210 at the nip 202. By using a thin belt 210, the fuser 200 does not rely on creep to strip media from the belt 210.

FIG. 2 depicts a medium 206 being fed to the nip 202 in the process direction A. The medium 206 includes a surface 207 on which marking material 209 (e.g., toner) is present. The surface 207 and marking material 209 contact the outer surface 212 of the belt 210 at the nip 202. The nip 202 is also referred to herein as the "first nip." In embodiments, the internal pressure roll 220 is rotated counter-clockwise, and the external pressure roll 244 is rotated clockwise, to convey the medium 206 through the first nip 202 in the process direction A and rotate the belt 210 counter-clockwise.

The medium 206 can be a sheet of paper, a transparency or packaging material, for example. Paper is typically classified by weight, as follows: lightweight: ≦about 75 gsm, mid-weight: about 75 gsm to about 160 gsm, and heavyweight: ≧160 gsm. For toner, a low mass is typically less than about 0.8 g/cm$^2$. The medium 206 can be, e.g., light-weight paper, and/or the marking material 209 can have a low mass, or the medium 206 can be a heavy-weight type, e.g., heavy-weight paper or a transparency, and/or the marking material 209 can have a high mass (e.g., at least about 0.8 g/cm$^2$). A larger amount of energy (both per thickness and per basis weight) is used to treat marking material (e.g., fuse toner) on coated media than on uncoated media.

The first nip 202 is the high-pressure nip of the fuser 200. In embodiments, the outer layer 246 of the external pressure roll 244 is deformed when the outer surface 248 is engaged with the belt 210 to form the first nip 202 between the outer surface 248 and the outer surface 212. The outer surface 222 of the internal pressure roll 220 may also be deformed by this contact depending on the material forming the outer surface 222.

The fuser 200 further includes a stripping mechanism 250 for stripping media from the outer surface 212 of the belt 210 after the media exit from the first nip 202 traveling in the process direction A.

Figure 3:
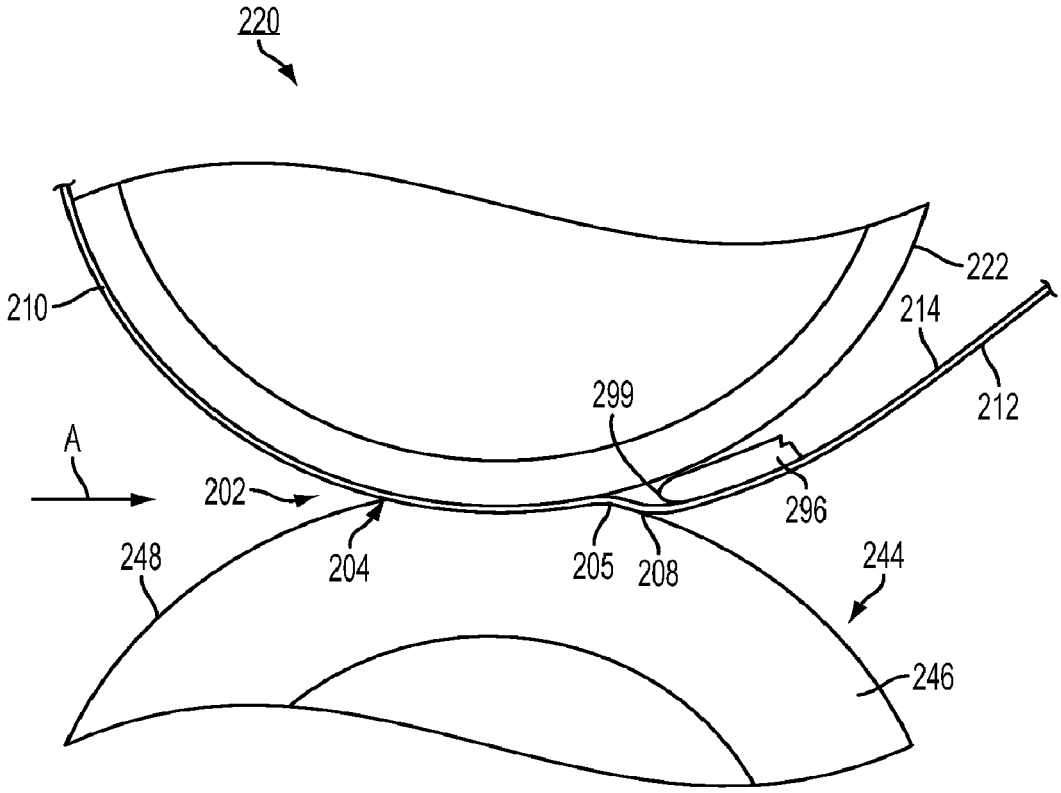
FIG. 3 depicts an enlarged partial view of the apparatus shown in FIG. 2.

FIG. 3 depicts a portion of the fuser 200 shown in FIG. 2, including the internal pressure roll 220, external pressure roll 244, belt 210 between the outer surface 222 of the internal pressure roll 220 and the outer surface 248 of the external pressure roll 244, and a stripping member 296 of the stripping mechanism 250. As shown, the first nip 202 extends in the process direction between an inlet 204, where media enter the first nip, and an outlet 205, where the media exit from the first nip 202.

As shown in FIG. 3, the belt 210 separates from the outer surface 222 of the internal pressure roll 220 at the outlet 205 of the first nip 202. The outer surface 212 of the belt 210 and the outer surface 248 of the external pressure roll 244 forms a second nip 208 downstream and adjacent to the outlet 205 of the first nip 202. The outer surface 212 of the belt 210 applies pressure to the outer surface 248 of the external pressure roll 244. The pressure at the second nip 208 is lower than the pressure at the first nip 202. Typically, the second nip 208 pressure is about 10 psi to about 15 psi. The second nip 208 is used to facilitate stripping of media from the outer surface 212 of the belt 210.

The stripping member 296 of the stripping mechanism 250 contacts the inner surface 214 of the belt 210 as the stripping member 296 is moved relative to the first nip 202. The stripping mechanism 250 is operable to allow the stripping member 296 to be positioned with respect to the first nip 202 to vary the forces and pressure applied to media by the outer surface 248 of the external pressure roll 244 and the outer surface 212 of the belt 210 as the media move through the second nip 208. The forces and pressure applied to media at the second nip 208 can be varied based on the stiffness of the media. A low pressure can be applied at the second nip 208 to facilitate optimized positioning of the stripping member 296 relative to the first nip 202 for stripping different types of media using different applied pressures. The combination of a thin fuser belt 210, which does not rely on creep for media stripping, and the stripping mechanism 250, which provides controlled stripping pressure, allows the marking material treatment function and the stripping function to be controllable substantially independent of the other for all media weights that may be used in embodiments of the fuser 200, while also providing prolonged belt life.

The stiffness of media used in the apparatuses useful for printing (such as the fuser 200) is dependent on certain media characteristics including thickness and weight. Thicker, heavier media can be stripped from the belt 210 by using a lower pressure than is sufficient for stripping thinner, lighter media. In the fuser 200, the pressure applied at the second nip 208 can be selectively set using the stripping mechanism 250 to apply a lower pressure for stripping thicker, heavier media, or a higher pressure for stripping thinner, lighter media from the belt 210. By using lower pressures for stripping heavier media, instead of using high pressures at the second nip 208 for all media weights, wear of the belt 210 can be significantly decreased during stripping.

Figure 4:
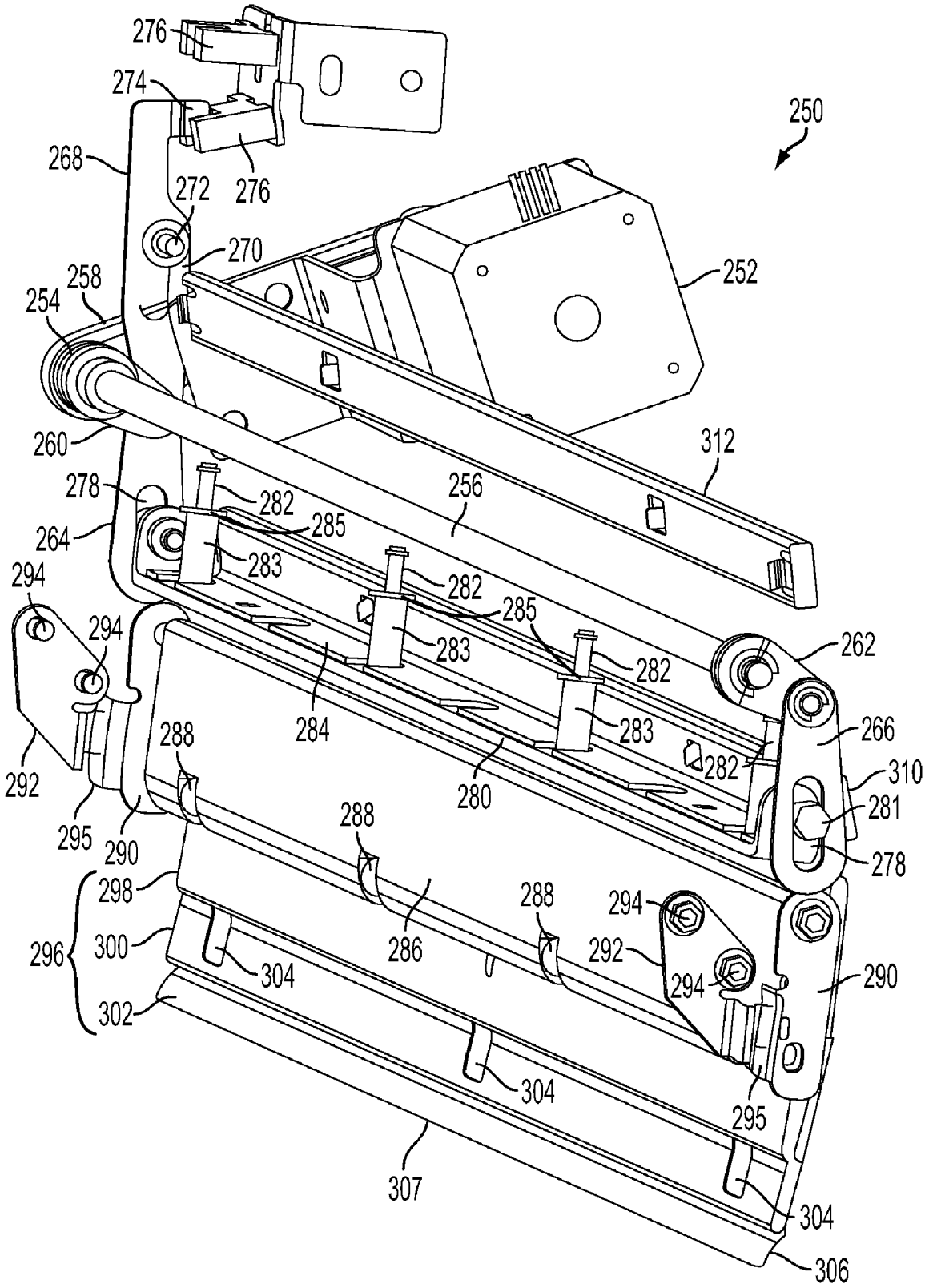
FIG. 4 depicts the media stripping mechanism shown in FIG. 2.
Figure 5:
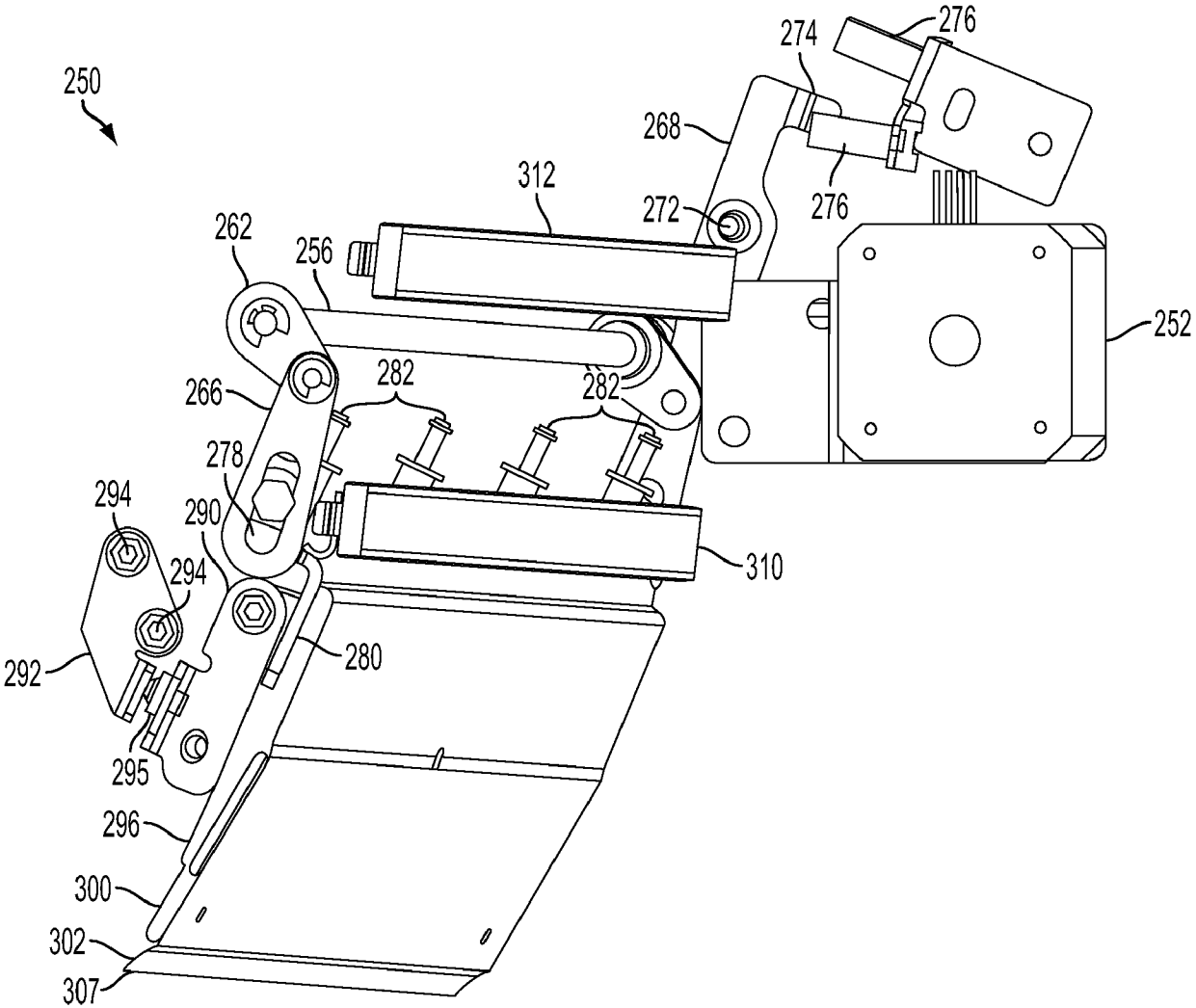
FIG. 5 depicts a bottom view of the stripping mechanism shown in FIG. 2.
Figure 6:
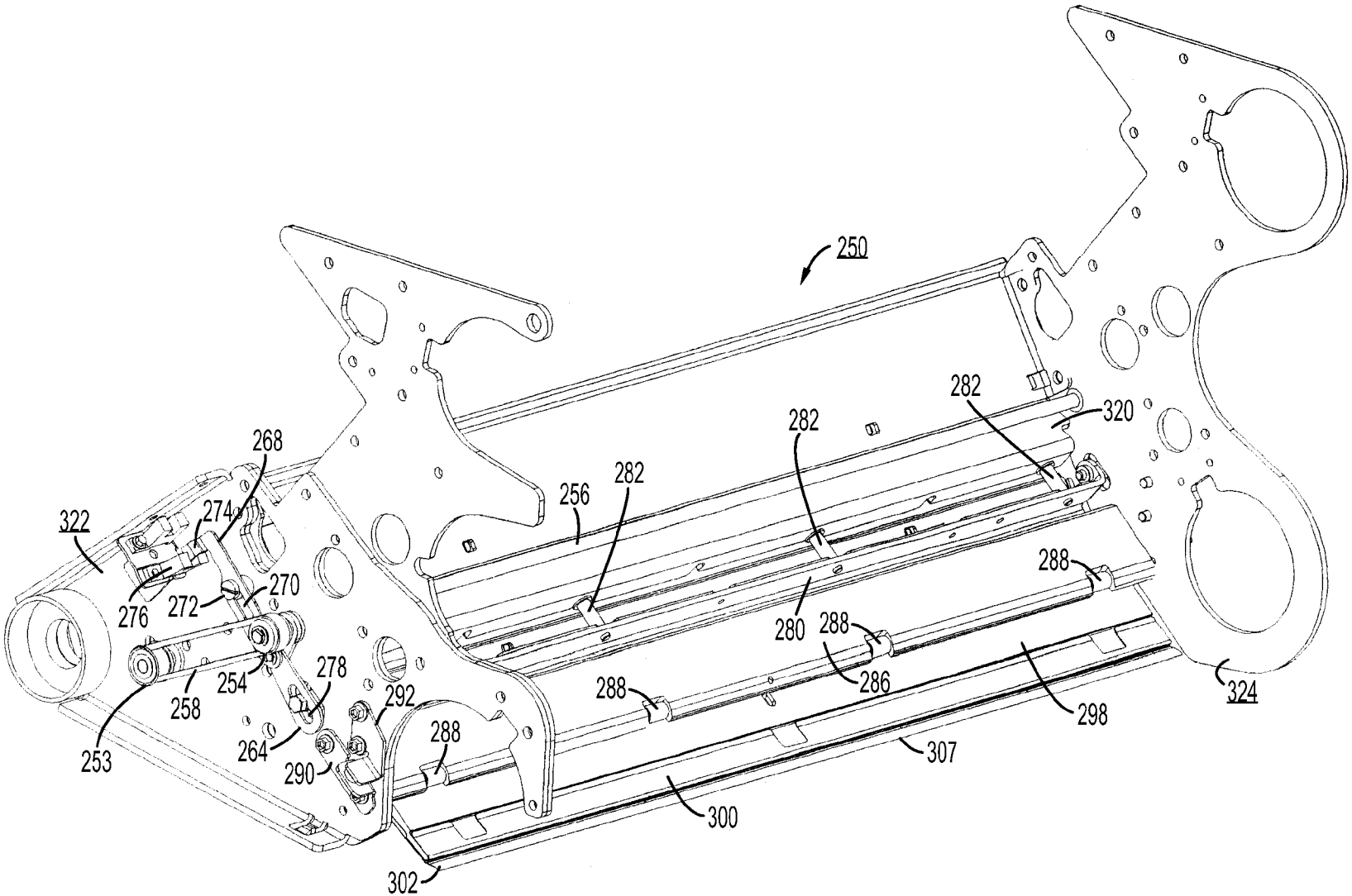
FIG. 6 depicts an exemplary embodiment of the stripping mechanism attached to plates.

FIGS. 4 to 6 depict an exemplary embodiment of the stripping mechanism 250. The illustrated stripping mechanism 250 includes a motor 252 with a rotatable shaft (not shown) and a first pulley 253 (FIG. 6) attached to the shaft. A second pulley 254 is attached to a shaft 256. A drive belt 258 is attached to the first pulley 253 and second pulley 254. In embodiments, the drive belt 258 is notched to engage with mating teeth on the first pulley 253 and second pulley 254. The drive belt 258 is rotated by the motor 252.

Lift crank arms 260, 262 are attached to opposite ends of the shaft 256. The lift crank arms 260, 262 are pivotally connected to lift links 264, 266, respectively.

A flag 268 is attached to the lift crank arm 260 and the lift link 264. The flag 268 includes a slot 270 and a tip 274. A pin 272 extends through the slot 270. The flag 268 is caused to move when the stripping member 296 is moved relative to the first nip 202 by running the motor 252. A stationary optical sensor 276 is adapted to sense the tip 274, as shown in FIGS. 4 to 6. The motor 252 is stopped when the sensor 276 senses the tip 274.

The lift links 264, 266 each include a slot 278. The lift links 264, 266 are attached to a bracket 280 by respective fasteners 281. A bracket 284 is attached to the bracket 280, such as by welding.

As shown in FIG. 4, spring-biased elements 282 are attached to the bracket 280 at laterally-spaced locations. The spring-biased members 282 each include a compression spring 283, a washer 285 and a retaining ring. As shown in FIG. 6, the spring-biased elements 282 push against a fixed connecting plate 320, exerting a force on the bracket 280.

The stripping mechanism 250 further includes a support member 286. The support member 286 has a plate configuration. Rollers 288 are attached to the support member 286 at laterally-spaced locations. Each roller 288 is mounted to rotate on a respective pin.

A bracket 290 is attached to each respective end face of the support member 286. The brackets 290 are attached to frame plates 322, 324 by fasteners (FIG. 6). A bracket 292 is attached to each respective bracket 290. The brackets 292 are attached to the frame plates 322, 324 by fasteners 294. The frame plates 322, 324 are connected by a series of connecting plates, including the connecting plate 320. The position of the support member 286 relative to the internal pressure roll 244 is adjustable using threaded adjustment screws 295 attached to the brackets 290.

The stripping mechanism 250 further includes a stripping member 296. The stripping member 296 is urged against the rollers 288 on the support member 286 by the belt 210. The stripping member 296 includes a stripping shoe 298. The stripping shoe 298 is fixedly attached to the bracket 280, such as by welding, fasteners, adhesive bonding, or the like. The stripping shoe 298 and bracket 280 are connected by the fasteners 281 to the portion of the stripping mechanism 250 located above the bracket 280 in FIG. 4.

In the illustrated embodiment, the stripping member 296 further includes a shim with a first member 300 and a second member 302. The first member 300 and second member 302 can be made of flexible material, e.g., a flexible metal, such as spring steel or the like, or a polymer. The first member 300 includes cut-out regions 304. The first member 300 and second member 302 are fixedly attached together, such as by welding, or the like, to form a unitary structure. In other embodiments, the shim can be a single piece of material, such as molded or machined piece of metal. The first member 300 and second member 302 can typically have lengths of about 12 mm and about 8 mm, respectively.

As shown in FIG. 4, the second member 302 includes a bottom surface 306 and a tip 307. The bottom surface 306 is curved concavely facing the inner surface 214. In embodiments, a low-friction material, such as TEFLON®, or the like, is applied at regions on the outer surfaces of the first member 300 and second member 302 that contact the inner surface 214 of the belt 210, such as the bottom surface 306 and tip 307 of the second member 302, and the bottom surface of the first member 300 facing the inner surface 214 of belt 210. The low-friction material can be a coating, adhesive tape, or the like. The low-friction material reduces wear of the inner surface 214 of the belt 210 during rotation of the belt 210.

In embodiments, the shim is detachably secured to the stripping shoe 298 to allow the shim to be replaced on the stripping member 296. For example, the first member 300 and second member 302 can be attached to the stripping shoe 298 by a clip, or like fasteners. The first member 300 can include at least one detent to retain the shim in position on the stripping shoe 298. The shim can be replaced when the low-friction material becomes worn, after a pre-determined number of media have been run in the fuser 200, or the belt 210 is replaced, for example.

In other embodiments of the stripping mechanism 250, the stripping member 296 includes a stripping shoe, such as stripping shoe 298, without a shim provided on the stripping shoe. For example, in FIG. 3, the stripping member 296 does not include a shim. In such embodiments, a low-friction material can be applied on at least the bottom surface and the tip 299 of the stripping shoe. The stripping shoe can have an extended length to compensate for the stripping member not including a shim. In such embodiments, the tip 299 of the stripping shoe forms a stripping surface in contact with the inner surface 214 of the belt 210.

The tip 307 of the second member 302 of the shim can be accurately positioned close to the outlet 205 of the nip 202 by the stripping mechanism 250. For example, the second member 302 can be positioned within a distance of about 5 mm or less from the outlet 205. The tip 307 of the second member 302 is configured to form a stripping surface with a small radius where the belt 210 overlies the tip 307 at the outlet of the second nip 208. For example, the tip 307 can be described by a radius having a length of about 5 mm or less. This small stripping radius provides a sufficient stripping force to facilitate stripping of different types of media (carrying marking material) from the outer surface 212 of the belt 210 at the second nip 208.

The stripping member 296 is selectively movable toward or away from the first nip 202 by the retraction mechanism of the stripping mechanism 250 located above the stripping member 296 in FIG. 4. The stripping member 296 can have a range of movement of at least about 10 mm between fully extended and retracted positions, for example. This movement of the stripping member 296 is approximately linear in the direction D shown in FIG. 2. When the stripping member 296 is moved away from the first nip 202 to the fully retracted (or "disengaged") position, the second member 302 of the shim no longer presses the belt 210 against the outer surface 248 of the second pressure roll 244 downstream of the outlet 205 of the first nip 202. In the fully retraced position, the second nip 208 is unformed and there is no second nip pressure.

When the stripping member 296 is moved downward and toward the first nip 202 in the direction D (i.e., extended) to the "engaged" position, the second member 302 of the shim presses the belt 210 against the outer surface 248 of the second pressure roll 244, forming the second nip 208. The second member 302 applies pressure to the inner surface 214 of the belt 210, causing the outer surface 212 of the belt 210 to apply pressure to the outer surface 248 of the external pressure roll 244. The belt 210 applies a desired amount of pressure to media at the second nip 208 to strip the media from the outer surface 212 of the belt 210. In the fully extended position, the second nip 208 pressure is at full pressure.

The springs 283 of the spring-biased members 282 provide a compliant force of the shim against the inner surface 214 of the belt 210. Increasing the spring constant of the springs 283 increases the magnitude of the spring force for a given change in length of the springs 283. Increasing the tension in the belt 210 increases the amount of compression of the springs 283. As the lift links 264, 266 move downward in the FIG. 4 orientation, the spring forces exerted by the springs 283 push the stripping member 296 toward the first nip 202 and form the second nip 208. Increasing the forces exerted by the springs 283 increases the pressure at the second nip 208.

The stripping mechanism 250 further includes at least one belt cleaning pad contacting the inner surface 214 of the belt 210 at spaced locations. Two belt cleaning pads 310, 312 are shown. The cleaning pads 310, 312 can be comprised of any suitable material that can remove solid and liquid debris from the inner surface 214 during rotation of the belt 210. For example, the cleaning pads 310, 312 can be comprised, e.g., of felt materials made of NOMEX® fibers available from E.I. du Pont de Nemours and Company. Removing debris from the belt 210 reduces the formation of certain image defects, such as banding, on media.

As shown in FIG. 2, in embodiments, the motor 252 of the stripping mechanism 250 is connected to a controller 350 in a conventional manner. The sensor 276 is also connected to the controller 350. In the illustrated embodiment, a media sensor 352 is located upstream of the first nip 202 to sense media before arriving at the first nip 202. The media sensor 352 is also connected to the controller 350. The controller 350 is adapted to automatically control the motor 252 of the stripping mechanism 250.

In embodiments, the motor 252 can be a stepper motor. The motor 252 can be run continuously at a selected speed during movement of the stripping member 296 between fully extended and retracted positions. In such embodiments, when the stripping member 296 is in the fully extended position, the second nip 208 is formed between the belt 210 and the external pressure roll 244. When the stripping member 296 is moved to the fully retracted position, the second nip 208 is unformed. The flag 274 can be sensed by the sensor 276 in both the fully-extended position and the fully-retracted position of the stripping member 296 to stop the motor 252 in both positions. In embodiments, lightweight media can be stripped from the belt 210 when the stripping member 296 is fully extended, while self-stripping, heavy-weight media can be stripped from the belt 210 when the stripping member 296 is retracted.

In other embodiments, the motor 252 can be operated in a step-wise manner to allow the stripping member 296 to be moved to positions that are intermediate the fully-extended and fully-retracted positions. In such embodiments, the lengths of the slots 278 in the lift links 264, 266 can be varied to allow the movement of the stripping member 296 to provide a variable amount of applied pressure at the second nip 208. The motor 252 can be operated in a step-wise manner to either increase the pressure at second nip 208 by moving the stripping member 296 toward the first nip 202, or decrease the pressure at the second nip 208 by moving the stripping member 296 away from the first nip 202 while still maintaining the second nip 208. For example, after heavy-weight media have been run in the fuser 200 using a lower applied pressure at the second nip 208, to then run light-weight media in the fuser 200, the pressure at the second nip 208 can be increased by moving the stripping member 296 toward the first nip 202 by step-wise operation of the motor 252.

In such embodiments, the controller 350 can be programmed to control the step-wise movement of the motor 250 to adjustably position the stripping member 296 relative to the first nip 202 for different media weights. The sensor 276 and flag 274 can be used as a counter for the position of the motor 250. In such embodiments, the stripping mechanism 250 can provide optimized stripping of different types of media.

The controller 350 can automatically control the motor 250 to rapidly adjust the pressure at the second nip 208 to the desired pressure before media arrive at the second nip 208. In embodiments, the motor 252 can be automatically actuated in about 0.05 seconds, for example. The controller 350 can be used to time increases and/or decreases of pressure applied at the second nip 208 resulting from operating the motor 250 on a sheet-by-sheet basis.

Applied pressure settings that are desirable for use with different media types, as well as timing settings, can be programmed in the controller 350. The nip pressure adjustment capabilities of the stripping mechanism 250 allow the pressure conditions at the second nip 208 to be optimized as a function of media properties without degradation in stripping performance. By using the stripping mechanism 250 to apply a lower stripping force at the second nip 208 for heavier media (or to apply no stripping force for self-stripping media) as compared to the stripping force used for lighter media, the life of the belt 210 can be significantly increased and run costs reduced.

An exemplary mode of operation of the stripping mechanism 250 when the motor 250 is operated in a continuous manner (i.e., not a step-wise manner) is as follows. Based on system control in the printing apparatus including the fuser 200, the stripping shoe 298 with attached first member 300 and second member 302 are selectively positioned in engagement with the inner surface 214 of the belt 210 to form the second nip 208 with a desired nip pressure, or moved away from the first nip 202 to unform the second nip 208. To fully retract the stripping shoe 298 and attached shim relative to the first nip 202, the motor 252 is actuated to rotate the drive belt 258 and turn the lift crank arms 260, 262. In the orientation of the stripping mechanism shown in FIG. 4, this movement of the lift crank arms 260, 262 lifts the respective lift links 264, 266 upwardly. The bracket 280 and fasteners 281 are pulled upwardly with the lift links 264, 266. The springs 283 attached to the bracket 280 are compressed against the connecting plate 320. The stripping member 296 to caused to move away from the first nip 202 (i.e., to retract). During this movement, the stripping shoe 296 moves up the surface of the stationary support member 286 that faces the inner surface 214 of the belt 210, with the stripping shoe 296 contacting the rollers 288 provided on the support member 286.

As the stripping member 296 is further retracted, the portion of the belt 210 that is downstream of the outlet 205 of the first nip 202 moves away from the outer surface 248 of the external pressure roll 244. As a result, the second nip 208 is unformed. The rotation of the drive belt 258 by the motor 252 also causes the flag 268 to move until the tip 274 is sensed by the sensor 276, indicating that the stripping member 296 has reached the fully-retracted position. The controller 350 then causes the motor 252 to be stopped.

To then move the stripping member 296 to the fully extended position at which the second nip 208 is formed, the motor 250 is operated to turn in the opposite direction to cause the stripping member 296 to move toward the first nip 202.

Embodiments of the stripping mechanism 250 can be used in various fuser architectures, in addition to the fuser 200 shown in FIG. 2, as well as in other apparatuses useful for printing that include a belt that contacts media, to facilitate stripping of such media from the belt. For example, the stripping mechanisms can be used in printing apparatuses to assist stripping of media from photoreceptor belts used to transfer images to media, and in printing apparatuses to assist stripping of media from intermediate belts used to transport images that are transferred to media. Apparatuses useful for printing can include more than one stripping mechanism for stripping media from more than one belt of the printing apparatuses.

Although the above description is directed toward fuser apparatuses used in xerographic printing, it will be understood that the teachings and claims herein can be applied to any treatment of marking material on media. For example, the marking material can be comprised of toner, liquid or gel ink, and/or heat- or radiation-curable ink; and/or the medium can utilize certain process conditions, such as temperature, for successful printing. The process conditions, such as heat, pressure and other conditions that are desired for the treatment of ink on media in a given embodiment may be different from the conditions suitable for xerographic fusing.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. An apparatus useful for printing, comprising:

a first member including a first outer surface;

a second member including a second outer surface;

a belt including an inner surface and an outer surface;

at least one heat source located internal to the belt for heating the belt;

a first nip formed by contact between the inner surface of the belt and the second outer surface and contact between the outer surface of the belt and the first outer surface; and a stripping mechanism comprising a stripping member disposed internal to the belt, wherein the stripping member is positionable relative to the first nip to vary a pressure applied by the outer surface of the belt against the first outer surface downstream from the first nip, and the stripping mechanism comprising at least one cleaning pad disposed in contact with the inner surface of the belt, wherein media are stripped from the outer surface of the belt after exiting from the first nip.

2. The apparatus of claim 1, wherein:

the belt separates from the second outer surface at an outlet of the first nip;

the stripping mechanism comprises a motor connected to the stripping member, the motor being operable to (i) move the stripping member toward the first nip to position the outer surface of the belt in contact with the first outer surface to form a second nip, which has a second nip pressure, adjacent the outlet of the first nip, or (ii) move the stripping member toward or away from the first nip to adjust the pressure applied by the outer surface of the belt against the first outer surface at the second nip, or (iii) move the stripping member away from the first nip to move the outer surface of the belt away from contact with the first outer surface downstream from the outlet of the first nip and unform the second nip.

3. The apparatus of claim 2, wherein the motor is connected to a controller which automatically controls the motor to adjust the position of the stripping member relative to the first nip to vary the pressure applied by the outer surface of the belt against the first outer surface at the second nip.

4. The apparatus of claim 3, wherein:

a media sensor is connected to the controller and positioned upstream of the first nip to sense the arrival of the media at the first nip; and the stripping mechanism comprises:

a flag which is moved when the stripping member is moved away from the first nip; and a sensor connected to the controller which senses when the flag is in a retracted position at which the second nip is unformed and the motor is stopped by the controller.

5. The apparatus of claim 2, wherein the stripping mechanism comprises a plurality of springs connected to the stripping member for resiliently biasing the stripping member against the inner surface of the belt at the second nip.

6. An apparatus useful for printing, comprising:

a first member including a first outer surface;

a second member including a second outer surface;

a belt including an inner surface and an outer surface;

a first nip formed by contact between the inner surface of the belt and the second outer surface and contact between the outer surface of the belt and the first outer surface; and a stripping mechanism comprising a stripping member disposed internal to the belt, the stripping member comprising a stripping shoe and a shim attached to the stripping shoe, the shim including a tip in contact with the inner surface of the belt, the shim being movable relative to the first nip to adjust pressure applied by the outer surface of the belt against the first outer surface adjacent the first nip, the stripping shoe rolls over a surface of a support member with the stripping shoe in contact with rollers when the shim is moved relative to the first nip, the stripping shoe being held against the support member by the belt, wherein media are stripped from the outer surface of the belt after exiting from the first nip.

7. The apparatus of claim 6, wherein:

the stripping mechanism is operable to adjustably position the tip of the shim within a distance of about 5 mm or less from an outlet of the first nip;

the tip of the shim is configured to form a stripping surface described by a radius having a length of about 5 mm or less; and the media are stripped from the outer surface of the belt overlying the tip.

8. An apparatus useful for printing, comprising:

a first pressure roll including a first outer surface;

a second pressure roll including a second outer surface;

a heated belt including an inner surface and an outer surface;

a first nip formed by contact between the inner surface of the belt and the second outer surface and contact between the outer surface of the belt and the first outer surface, the first nip including an inlet where media enter the first nip and an outlet where the media exit the first nip; and a stripping mechanism comprising:

a motor;

a stripping member connected to the motor and disposed internal to the belt, wherein the motor is operable to position the stripping member relative to the first nip to vary a pressure applied by the outer surface of the belt against the first outer surface downstream from the outlet of the first nip, and the media are stripped from the outer surface of the belt after exiting from the outlet of the first nip; and a plurality of springs connected to the stripping member, the springs resiliently biasing the stripping member against the inner surface of the belt.

9. The apparatus of claim 8, wherein:

the belt separates from the second outer surface at the outlet of the first nip;

the motor is connected to a controller; and the controller automatically controls actuation of the motor to move the stripping member (i) toward the first nip to position the outer surface of the belt in contact with the first outer surface to form a second nip adjacent the outlet of the first nip, (ii) toward or away from the first nip to adjust the pressure applied by the outer surface of the belt against the first outer surface at the second nip, or (iii) away from the first nip to move the outer surface of the belt away from contact with the first outer surface downstream from the outlet of the first nip and unform the second nip.

10. The apparatus of claim 9, wherein:

a media sensor is connected to the controller and positioned upstream of the first nip to sense the arrival of the media at the first nip; and the stripping mechanism comprises:

a flag which moves when the stripping member is moved away from the first nip; and a sensor connected to the controller which senses when the flag is in a retracted position at which the second nip is unformed and the motor is stopped by the controller.

11. The apparatus of claim 8, wherein:

the stripping member comprises a stripping shoe and a shim attached to the stripping shoe;

the stripping shoe rolls over a surface of a support member with the stripping shoe in contact with rollers when the stripping member is moved relative to the first nip, the stripping shoe being held against the support member by the belt;

the shim comprises a tip and a low-friction material which contact the inner surface of the belt; and the shim is movable relative to the first nip to adjust the pressure applied by the outer surface of the belt against the first outer surface adjacent the outlet of the first nip.

12. A method of stripping media from a surface in an apparatus useful for printing, the apparatus comprising a first member including a first outer surface, a second member including a second outer surface, a belt including an inner surface and an outer surface, at least one heat source located internal to the belt for heating the belt; a first nip formed by contact between the inner surface of the belt and the second outer surface and contact between the outer surface of the belt and the first outer surface, and a stripping mechanism including a stripping member disposed internal to the belt and at least one cleaning pad disposed in contact with the inner surface of the belt, the method comprising:

positioning the stripping member relative to the first nip to vary a pressure applied by the outer surface of the belt against the first outer surface downstream from an outlet of the first nip to a first pressure;

contacting a first medium carrying a first marking material with the outer surface of the belt at the first nip; and stripping the first medium from the outer surface of the belt downstream from the first nip with the stripping member.

13. The method of claim 12, wherein:

the first member is a first pressure roll;

the second member is a second pressure roll;

the first nip includes an inlet where the first medium enters the first nip and an outlet where the first medium exits from the first nip;

the belt separates from the second pressure roll at the outlet of the first nip;

the stripping member is located between the second pressure roll and the inner surface of the belt; and a second nip is located adjacent the outlet of the first nip.

14. The method of claim 12, further comprising automatically controlling a motor connected to the stripping member with a controller to reposition the stripping member relative to the first nip to vary the pressure applied by the outer surface of the belt against the first outer surface at a second nip adjacent the first nip before the first medium enters the second nip.

15. The method of claim 12, further comprising automatically controlling a motor connected to the stripping member with a controller to (i) move the stripping member toward the first nip to cause the outer surface of the belt to contact the first outer surface and form a second nip adjacent an outlet of the first nip, (ii) move the stripping member toward or away from the first nip to vary the pressure applied by the outer surface of the belt against the first outer surface at the second nip to the first pressure, or (iii) move the stripping member away from the first nip to move the outer surface of the belt away from contact with the first outer surface to unform the second nip.

16. The method of claim 12, further comprising:

sensing the arrival of the first medium at an inlet of the first nip with a media sensor connected to the controller and positioned upstream of the first nip; and positioning the stripping member relative to the first nip to vary the pressure applied by the outer surface of the belt against the first outer surface at a second nip adjacent the first nip to the first pressure.

17. The method of claim 12, further comprising:

moving the stripping mechanism toward the first nip to vary the pressure applied by the outer surface of the belt against the first outer surface at a second nip adjacent the first nip to a second pressure higher than the first pressure;

contacting a second medium carrying a second marking material with the outer surface of the belt at the first nip, wherein the second medium is lighter than the first medium; and stripping the second medium from the outer surface of the belt at the second nip with the stripping member using the second pressure.

18. The method of claim 17, further comprising:

sensing the arrival of the second medium at an inlet of the first nip with a media sensor positioned upstream of the first nip and connected to a controller; and moving the stripping member toward the first nip to increase the pressure applied by the outer surface of the belt against the first outer surface at the second nip from the first pressure to a second pressure.

19. An apparatus useful for printing, comprising:

a first roll including a first outer surface;

a second roll including a second outer surface;

a third roll including a third outer surface;

a belt supported on the second outer surface and the third outer surface, the belt including an inner surface and an outer surface;

a first nip formed by contact between the inner surface of the belt and the second outer surface and contact between the outer surface of the belt and the first outer surface, the first nip having an inlet at which a medium enters the first nip and an outlet at which the medium exits from the first nip; and a stripping mechanism comprising a stripping member disposed between the second outer surface and the inner surface of the belt, the stripping member being positionable relative to the first nip, without changing the location of the inlet or the outlet of the first nip, to position the outer surface of the belt in contact with the first outer surface to form a second nip downstream from, and adjacent to, the outlet of the first nip and to vary a pressure applied by the outer surface of the belt against the first outer surface at the second nip, the inner surface of the belt being spaced from the second outer surface at the second nip, wherein media are stripped from the outer surface of the belt after exiting from the first nip.

* * * * *